US006007462A

United States Patent [19]

Chen

[11] Patent Number: 6,007,462

[45] Date of Patent: Dec. 28, 1999

[54] EXERCISE DEVICE

[76] Inventor: Chao-Chuan Chen, No. 20, Lane 1265, Chung Cheng Road, Wu Feng, Taichung, Taiwan

[21] Appl. No.: 09/026,128

[22] Filed: Feb. 19, 1998

[51] Int. Cl.[6] ..... A63B 22/06

[52] U.S. Cl. ..... 482/57; 482/51; 482/52

[58] Field of Search ..... 482/51, 52, 53, 482/57, 70, 903, 79–80

[56] References Cited

U.S. PATENT DOCUMENTS

| | | | |
|---|---|---|---|
| 4,880,225 | 11/1989 | Lucas et al. | 482/62 |
| 5,324,242 | 6/1994 | Lo | 482/903 |
| 5,383,829 | 1/1995 | Miller . | |
| 5,549,526 | 8/1996 | Rodgers, Jr. | 482/57 |
| 5,653,662 | 8/1997 | Rodgers | 482/70 |
| 5,692,994 | 12/1997 | Eschenbach | 482/57 |
| 5,746,683 | 5/1998 | Lee | 482/57 |
| 5,823,917 | 10/1998 | Chen | 482/57 |

OTHER PUBLICATIONS

Health Rider "Elliptical Cross Trainer" brochure, 1998.

*Primary Examiner*—Stephen R. Crow
*Attorney, Agent, or Firm*—Browdy and Neimark

[57] ABSTRACT

An exercise device is composed of a base, two cranks, two handles, two connection rods, and two slide wheels. The cranks are fastened pivotally and coaxially with the base. Each of the two handles is composed of a first rod member and a second rod member capable of sliding along the direction of the longitudinal axis of the first rod member. The connection rods are fastened pivotally with the cranks and the second rod members. The slide wheels are mounted on the base such that the slide wheels are in contact with the undersides of the connection rods for increasing the contact areas of the slide wheels and the connection rods so as to minimize the wear of the slide wheels.

9 Claims, 6 Drawing Sheets

EXERCISE DEVICE

FIELD OF THE INVENTION

The present invention relates generally to an exercise device.

BACKGROUND OF THE INVENTION

A stationary exercise device disclosed in the U.S. Pat. No. 5,383,829 is composed of a base which is provided in both sides of the front segment thereof with two guide rails, and in the rear segment thereof with a resisting wheel. A pivot of the resisting wheel is provided respectively at both ends thereof with a crank. The two guide rails are used to guide two slide wheels which are fastened with the undersides of the front ends of two connection rods. The two connection rods are provided respectively at the midsegment thereof with a pedal. The connection rods are fastened pivotally and respectively at the rear end thereof with the crank. As the pedals are operated by the feet of a person, the slide wheels are activated to move back and forth along the guide rails. In the meantime, the cranks are actuated to turn such that the resisting wheel is driven to rotate. As a result, the stationary exercise device is capable of providing a leg exercise similar in effect to the mountain-climbing.

Such a prior art exercise device as described above is defective in design in that the contact areas of the two slide wheels and the two guide rails are so small as to cause the slide wheels to wear out easily, thereby undermining the service life span of the exercise device. In addition, the construction of the prior art exercise device is complicated by the two guide rails which can not be easily mounted with precision. Moreover, the installation of the guide rails calls for the use of many accessories, thereby resulting in a substantial increase in the cost of making the stationary exercise device.

SUMMARY OF THE INVENTION

It is primary objective of the present invention to provide an exercise device which is simple in construction and can be therefore made easily and economically.

It is another objective of the present invention to provide an exercise device which can be used for a relatively long period of time in spite of frequent use.

In keeping with the principle of the present invention, the foregoing objectives of the present invention are attained by an exercise device consisting of a base, two cranks, two handles, two connection rods, and two slide wheels. The base is rested on the floor. The two cranks are fastened pivotally with the base by a common pivot. Each of the two handles is composed of a first rod member and a second rod member capable of sliding along the longitudinal axis of the first rod member. The two connection rods are fastened pivotally with the two cranks and the two second rod members. The two slide wheels are mounted on the base such that the slide wheels are in contact with the undersides of the two connection rods for increasing the contact areas of the two slide wheels and the two connection rods so as to minimize the wear of the two slide wheels, thereby resulting in the prolongation of the service life span of the exercise device.

The foregoing objectives, features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
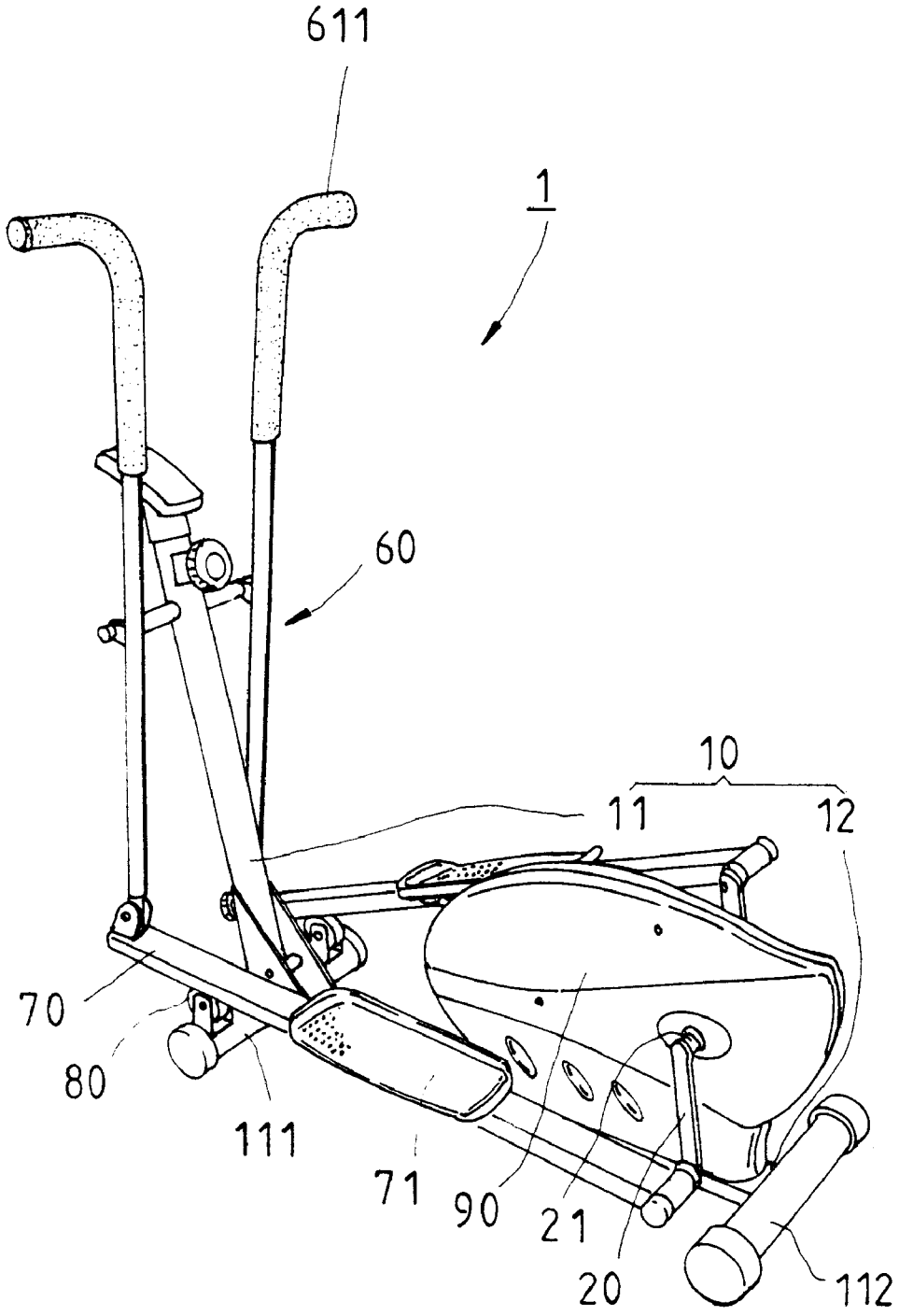
FIG. 1 shows a perspective view of an exercise device of the present invention.
Figure 2:
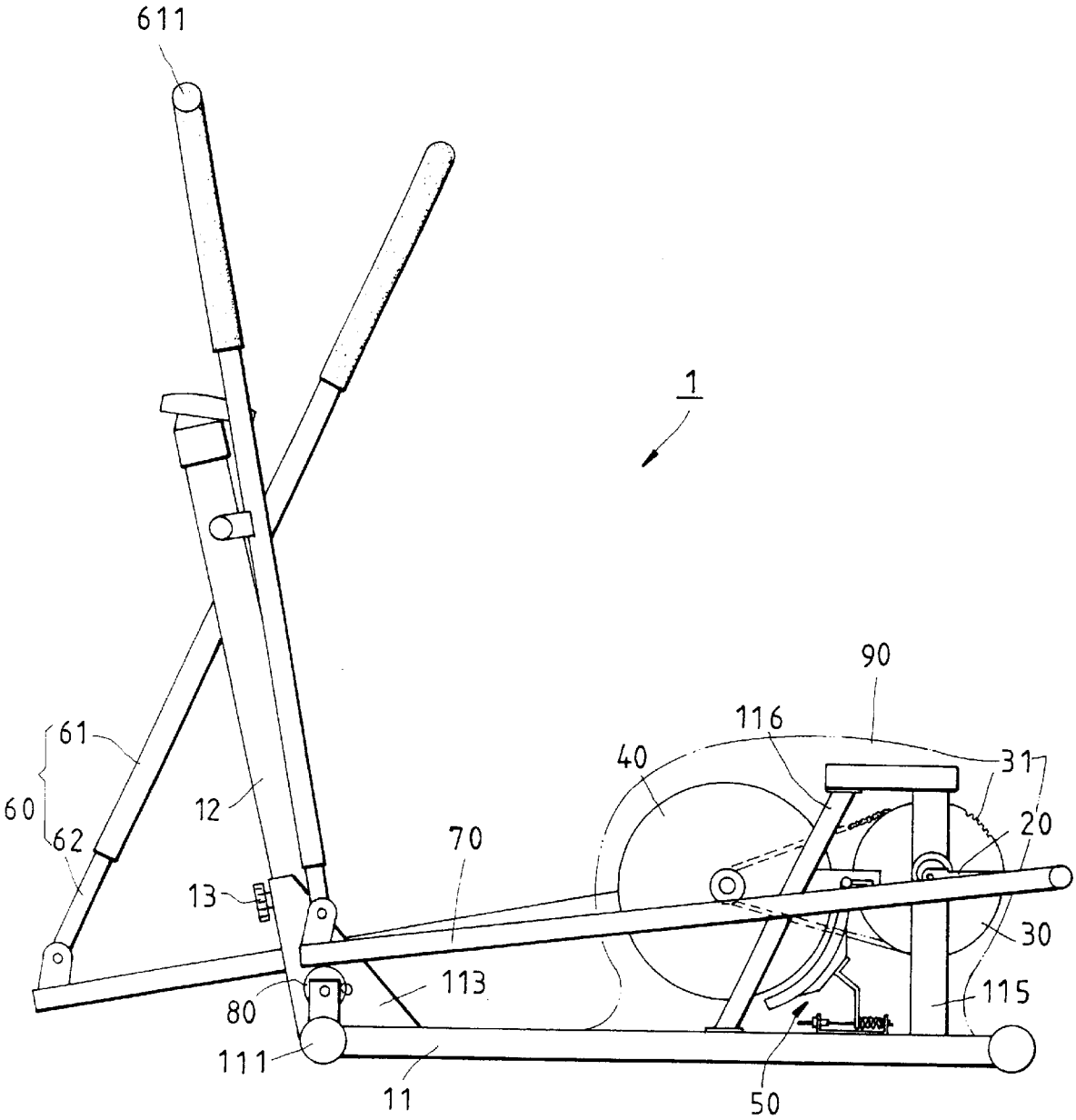
FIG. 2 shows a side view of the present invention, with the protective shields of the drive wheel and the resisting wheel being denoted by the dotted lines.
Figure 3:
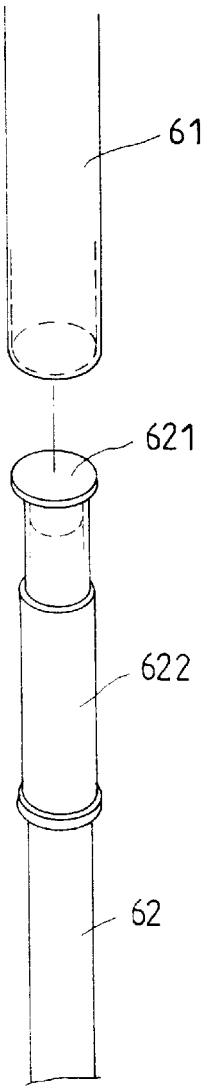
FIGS. 3 and 4 show partial exploded views of the present invention.
Figure 4:
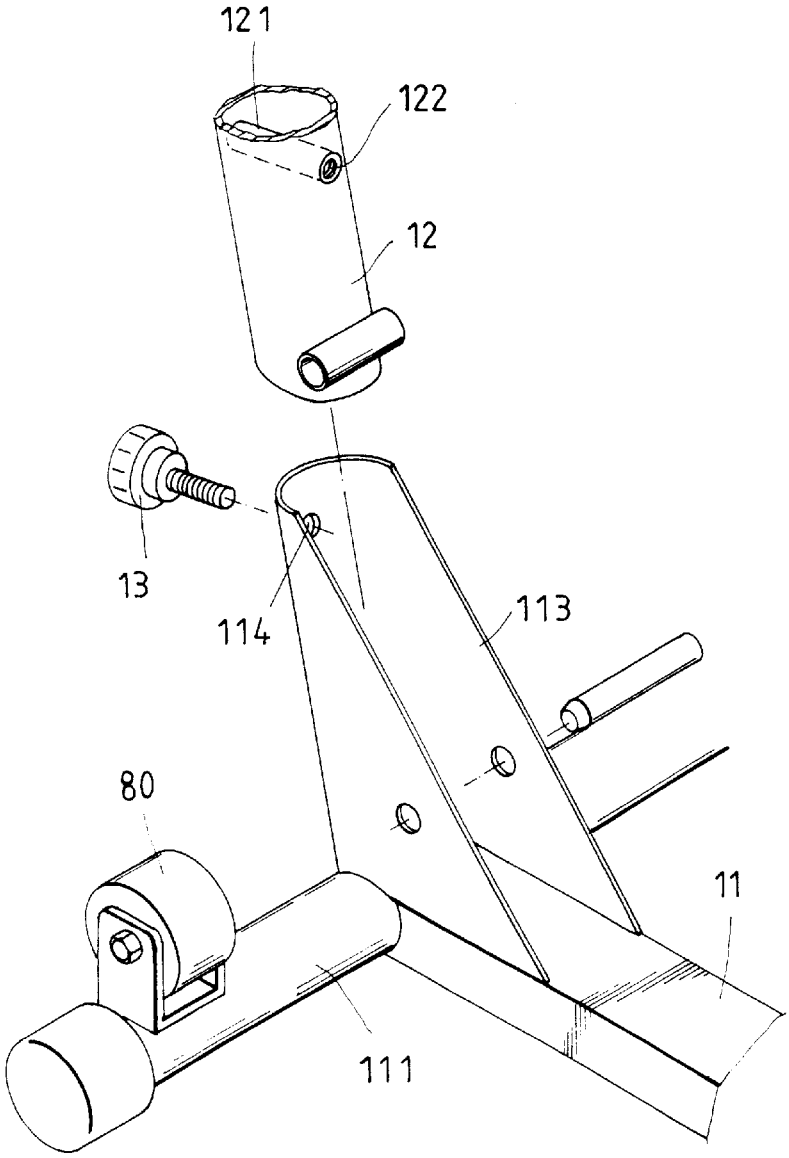

As shown in FIGS. 1–4, an exercise device 1 embodied in the present invention is composed of the component parts which are described explicitly hereinafter.

A base 10 is made up of a bottom rod 11 and an upright rod 12. The bottom rod 11 is provided at the front end thereof with a front cross rod 111 fastened therewith, and at the rear end thereof with a rear cross rod 112 fastened therewith. The front cross rod 111 and the rear cross rod 112 enable the base 10 to rest on the floor stably. The bottom rod 11 is provided on the front segment thereof with a pivoting seat 113 which is in turn provided in the wall of the front end thereof with a through hole 114. The upright rod 12 is fastened pivotally at the bottom end thereof with the pivoting seat 113 of the bottom rod 11 such that the upright rod 12 can be swiveled to an extent that the upright rod 12 forms a predetermined angle with the bottom rod 11. The upright rod 12 is provided in the vicinity of the bottom end thereof with a fastening tube 121 opposite in location to the through hole 114 of the pivoting seat 113 and having inner threads. The fastening tube 121 is embedded and provided respectively at both ends thereof with a through hole 122, which can be in alignment with the through hole 114 of the pivoting seat 113 at such time when the upright rod 12 is turned to form a predetermined angle with the base rod 11. A bolt 13 is engaged with the fastening tube 121 via the through hole 114 for locating the upright tube 12.

Two cranks 20 are fastened pivotally with a first support rod 115 by a pivot 21 such that the two cranks 20 are located at both sides of the first support rod 115, and that the two cranks 20 are opposite in location to each other.

A drive wheel 30 is mounted on the pivot 21 and is provided along the circumference thereof with teeth 31.

A resisting wheel 40 is mounted on a second support rod 116 located on the bottom rod 11 such that the resisting wheel 40 is linked with the drive wheel 30, and that the resisting wheel 40 is driven by the drive wheel 30.

A magnetic resistance force generator 50 is mounted on the base 10 for providing the resisting wheel 40 with resistance.

Two handles 60 are respectively composed of a first rod member 61 and a second rod member 62, which are fastened pivotally and coaxially with the upright rod 12. The first rod member 61 is provided at the top end thereof with a hand grip 611, whereas the second rod member 62 is fitted from the bottom end of the first rod member 61 into the first rod member 61. The second rod member 62 is provided at the top end thereof with a slide block 621, and around the rod body thereof with a slide jacket 622, so as to enable the second rod member 62 to slide along the direction of the longitudinal axis of the first rod member 61.

Two connection rods 70 are fastened pivotally with the two cranks 20.

Two slide wheels 80 are mounted on the front cross rod 111 such that the two slide wheels 80 are in contact with the undersides of the two connection rods 70.

A protective shield 90 is fastened with the bottom rod 11 for shielding the drive wheel 30, the resisting wheel 40, and so forth.

Figure 5:
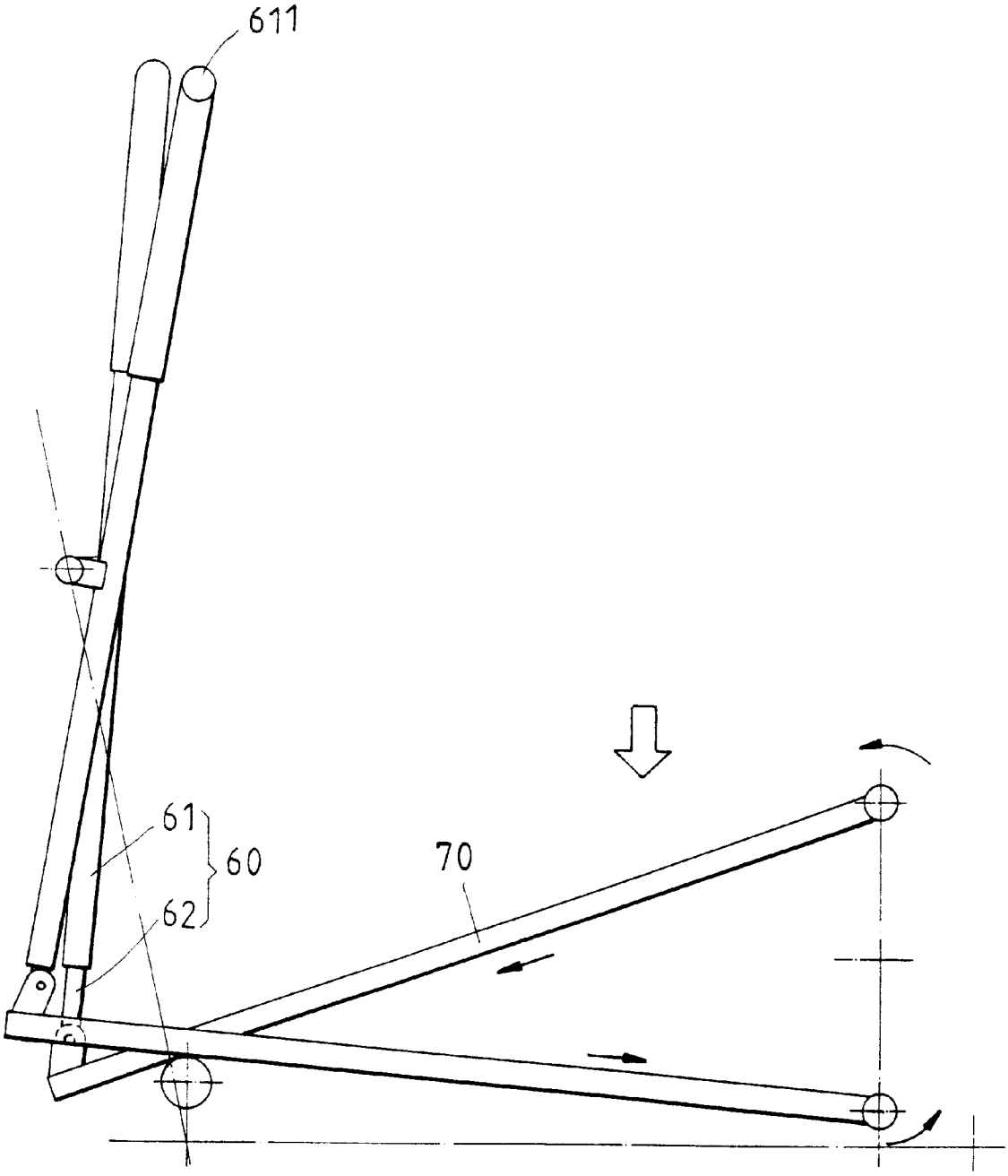
FIGS. 5 and 6 show schematic views of the present invention at work.
Figure 6:
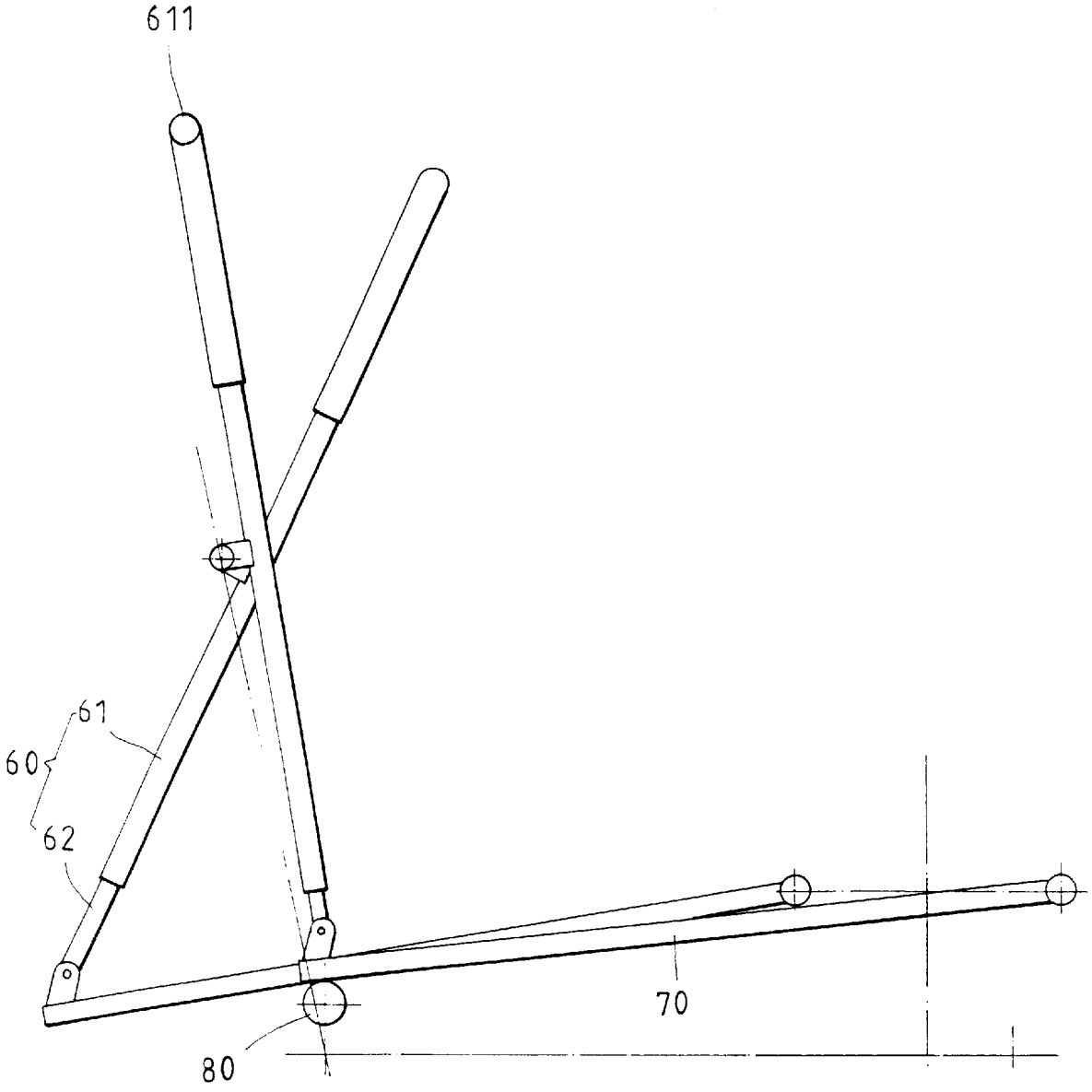

Now referring to FIGS. 5 and 6, the pedals 71 are stepped on by both feet of a user of the exercise device 1 of the present invention. In the meantime, both hands of the user hold the hand grips 611 of the two handles 60. As the connection rods 70 are actuated by both feet of the user, the cranks 20 are actuated by the rear ends of the connection rods 70 to turn so as to drive the resisting wheel 40 to turn. As a result, the resisting wheel 40 becomes the load of the two connection rods 70. In the meantime time, the undersides of the front segments of the connection rods 70 slide back and forth on the two slide wheels 80. The ankles of both feet of the user are exercised effectively by the motion of the connection rods 70. While the connection rods 70 are in motion, the two handles 60 are actuated to swivel back and forth on the pivot so as to exercise both hands of the user. Moreover, the second rod members 62 are also actuated to slide along the longitudinal axes of the first rod members 61 in view of the fact that the distance between the pivoting point of the first rod member 61 and the upright rod 12 and the pivoting point of the second rod member 62 and the connection rod 70 is changed.

The exercise device 1 of the present invention is capable of exercising both legs and both hands of a user. In addition, the device of the present invention has several advantages, which are explicitly described hereinafter.

The slide wheels 80 are not vulnerable to damage caused by hard wear in view of the fact that the slide wheels 80 are located on the front cross rod 111 of the base 10 to make contact with the undersides of the connection rods 70.

The slide wheels 80 are fastened with the front cross rod 111 of the base 10 by welding and are capable of sliding without the slide rails. In the other words, the exercise device 1 of the present invention is devoid of the slide rails and is therefore cost-effective.

The function of the exercise device 1 of the present invention is not compromised by the slide wheels 80 which are located under the connection rods 70. As a result, the assembly of the exercise device 1 of the present invention is relatively easy.

Figure 7:
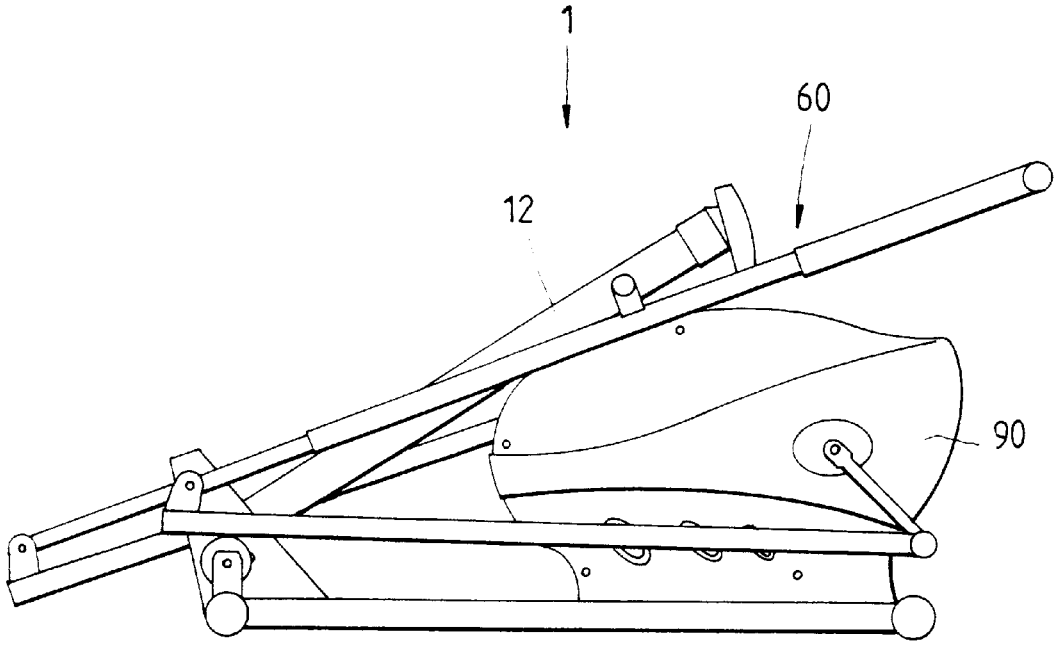
FIG. 7 shows a side view of the present invention in a folded state.

The exercise device 1 of the present invention can be folded to facilitate the easy storage and shipment, as illustrated in FIG. 7. The bolt 13 can be disengaged with the upright rod 12 so as to unable the upright rod 12 and the handles 60 to be laid on the protective shield 90.

What is claimed is:

1. An exercise device comprising:

a base rested on a floor or ground surface;

two cranks fastened pivotally with said base by a pivot;

two handles each consisting of a first rod member and a second rod member slidable relative to one another along the direction of a longitudinal axis of said first rod member during use of said exercise device, said first rod members of said two handles being fastened pivotally and coaxially with said base;

two connection rods fastened pivotally with said two cranks; and two slide wheels mounted on said base such that said slide wheels make contact with undersides of said two connection rods.

2. The exercise device as defined in claim 1, wherein said pivot of said cranks is provided with a drive wheel mounted thereon; and wherein said base is provided with a resisting wheel mounted thereon such that said resisting wheel is linked with said drive wheel.

3. The exercise device as defined in claim 1, wherein said base has a bottom rod and an upright rod fastened with said bottom rod such that said upright rod and said bottom rod form therebetween an angle; wherein said two handles are fastened pivotally and coaxially on both sides of said upright rod; and wherein said two cranks are fastened pivotally with said bottom rod.

4. The exercise device as defined in claim 3, wherein said bottom rod is provided at one end thereof with a pivoting seat fastened therewith and provided in a wall thereof with a through hole; and wherein said upright rod is fastened pivotally at one end thereof with a said pivoting seat and is provided with a fastening tube opposite in location to said through hole of said pivoting seat and having respectively at both ends thereof a through hole, said fastening tube provided with inner threads engageable with a bolt via said through hole of said pivoting seat.

5. The exercise device as defined in claim 3, wherein said two cranks are opposite in location to each other.

6. The exercise device as defined in claim 2, wherein said base is provided with a magnetic resistance force generator mounted thereon for providing said resisting wheel with a resistance force.

7. The exercise device as defined in claim 1, wherein said second rod members of said handles are respectively fitted into said first rod members and are provided respectively with a slide block and a slide jacket for enabling said second rod members to slide along the direction of a longitudinal axis of said first rod members.

8. The exercise device as defined in claim 1, wherein said first rod members of said two handles are provided respectively at one end thereof with a hand grip fastened therewith.

9. The exercise device of claim 1 wherein said first and second rod members of said handles are provided with a slide block and a slide jacket for enabling said second rod members to slide along the direction of a longitudinal axis of said first rod members.

* * * * *